US006048075A

United States Patent [19]

Lai

[11] Patent Number: 6,048,075

[45] Date of Patent: Apr. 11, 2000

[54] SIGN BOX FRAME HAVING COVER BOARD PARALLEL RAILS, AND PLURALITY OF TRANSPARENT LAMP HOLDERS AND LAMPS FOR MOUNTING ON A WALL

[76] Inventor: Ten-Ta Lai, No 54, Szu-Yuan Rd., Hsin-Chuang City, Taipei Hsien, Taiwan

[21] Appl. No.: 09/208,007

[22] Filed: Dec. 9, 1998

[51] Int. Cl.[7] ..... F21V 1/02

[52] U.S. Cl. ..... 362/240; 362/912; 362/223; 362/249; 362/133; 362/225; 40/564

[58] Field of Search ..... 362/812, 240, 362/223, 249, 133, 225; 312/223.5; 40/564, 568, 575

[56] References Cited

U.S. PATENT DOCUMENTS 5,842,297 12/1998 Tung ..... 40/546
5,902,034 5/1999 Santosuosso et al. ..... 362/125

*Primary Examiner*—Sandra O'Shea
*Assistant Examiner*—Ronald E. Delgizzi
*Attorney, Agent, or Firm*—Bacon & Thomas

[57] ABSTRACT

A sign box includes a box frame fixedly mounted on an outside wall of a building, a plurality of transparent lamp tube holders respectively mounted in the box frame and holding a respective lamp tube, a pair of parallel rails provided at one side of the box frame and defining a sliding track, a cover board inserted into the sliding track to keep the lamp tube holders from sight, and an electric box hinged to the box frame at a bottom side to hold fluorescent ballasts and starters of the lamp tubes in the lamp tube holders.

11 Claims, 7 Drawing Sheets

SIGN BOX FRAME HAVING COVER BOARD PARALLEL RAILS, AND PLURALITY OF TRANSPARENT LAMP HOLDERS AND LAMPS FOR MOUNTING ON A WALL

BACKGROUND OF THE INVENTION

The present invention relates to an acrylic sign box, and more particularly to such an acrylic sign box that can be conveniently opened for allowing the maintenance engineer to inspect its internal electric arrangement.

Sign box with lighting means may be installed in the outside wall of a store for display of an advertisement. A sign box for this purpose is generally comprised of a metal box frame, a plurality of lamp holders mounted inside the box frame to hold a respective lamp tube, and light-permeable acrylic cover boards covered on the peripheral sides of the box frame. Each acrylic cover board has a design on it. Because the box frame is made of metal, it is durable in use. However, the service life of the lamp tubes is short. Because the average service life of the lamp tubes is about 8 to 12 months, the lamp tubes must be replaced frequently during the service life of the box frame. When replacing a lamp tube, the acrylic cover boards must be removed from the box frame so that the maintenance engineer or worker can take the damaged lamp tube away, and then install a new lamp tube. During a maintenance work, a lift may be used to lift the maintenance engineer or worker to a certain height, enabling the maintenance engineer or worker to take the damaged lamp tube away for a replacement. Alternatively, a ladder may be used so that the maintenance engineer or work can climb to the designed height. However, it is not an easy job to remove acrylic cover boards from the box frame of a sign box. For removing acrylic cover boards from the box frame of a big scale sign box, a hoist shall be used. Because the service life of lamp tubes is short, the sign box user shall have to check the working condition of the lamp tubes regularly, and replace damaged lamp tubes. However, frequently loading and unloading the acrylic cover boards may do damage to the connection structure between the box frame and the wall of the building.

SUMMARY OF THE INVENTION

The present invention has been accomplished to provide a sign box which eliminates the aforesaid problems. According to one aspect of the present invention, the sign box comprises a box frame having two parallel rails arranged at an outer lateral side and defining a sliding track, and a side cover board inserted into the sliding track to close the outer lateral side of the box frame. According to another aspect of the present invention, transparent, cylindrical lamp tube holders are respectively installed in the box frame to hold a respective lamp tubes. When the side cover board is removed from the box frame, the lamp tubes can be conveniently taken out of the respective lamp tube holders for a replacement. According to still another aspect of the present invention, the fluorescent ballasts and starters of the lamp tubes are installed in an electric box, which is hinged to the box frame at the bottom. When the electric box is opened, the maintenance engineer can inspect the fluorescent ballasts and the starters conveniently.

DETAILED DESCRIPTION OF THE PREFERRED EMBODIMENT

Figure 1:
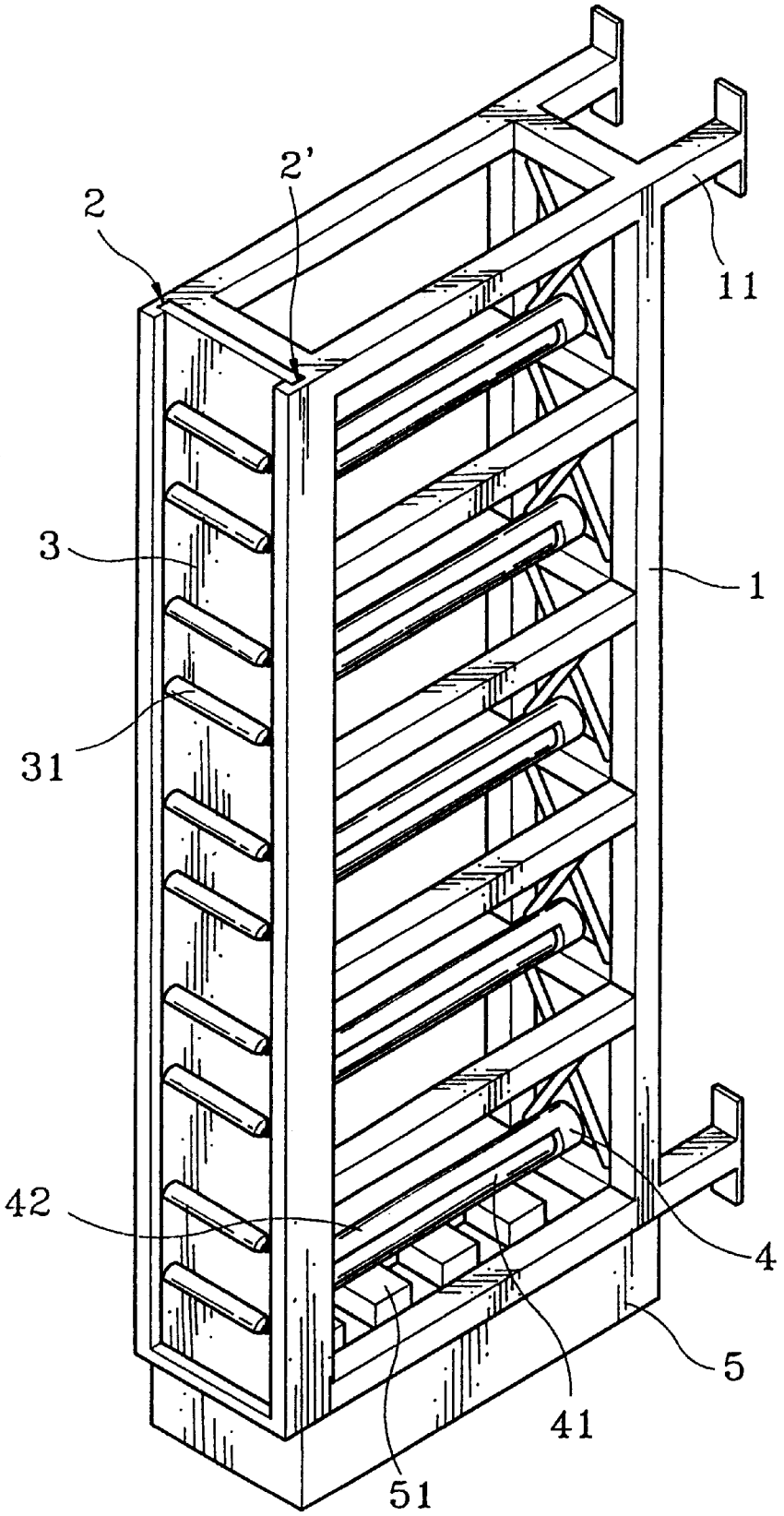
FIG. 1 is a perspective view of a sign box according to one embodiment of the present invention.
Figure 2:
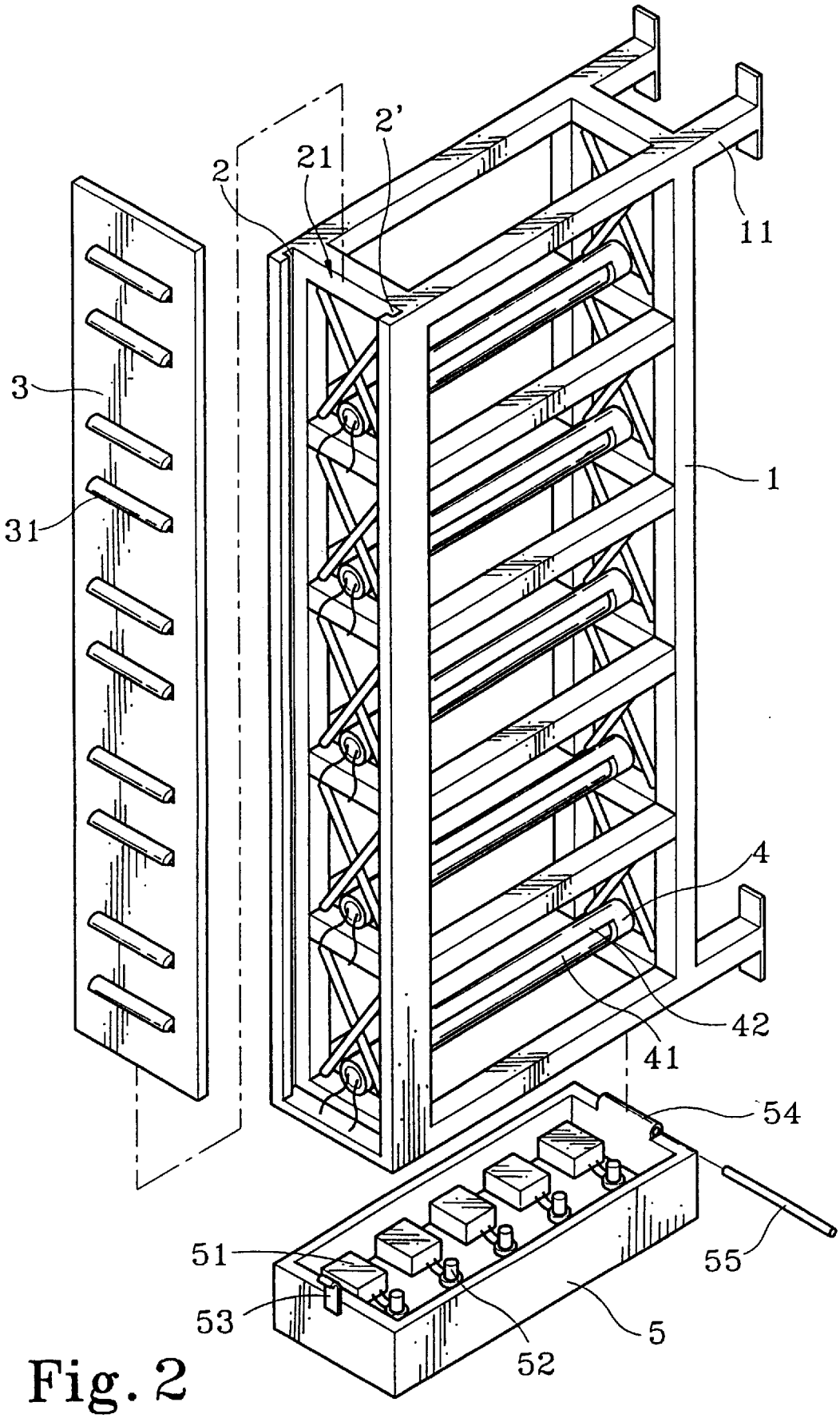
FIG. 2 is an exploded view of the sign box shown in FIG. 1.

Referring to FIGS. 1 and 2, an acrylic sign box in accordance with the present invention is generally comprised of a box frame 1, a side board 3, a plurality of lamp tube holders 4, and an electric box 5.

The box frame 1 comprises a plurality of mounting legs 11 at one side for mounting, two parallel rails 2 and 2' longitudinally arranged at one side opposite to the mounting legs 11 and defining a longitudinal sliding track 21. The side board 3 is inserted into the longitudinal sliding track 21 between the parallel rails 2 and 2'. The longitudinal sliding track 21 has an opened top side through which the side board 3 is inserted into the longitudinal sliding track 21, and a closed bottom side at which the side board 3 is stopped. The side board 3 has a plurality of air vents 31 for ventilation. The lamp tube holders 4 are tubular members made of transparent material (transparent plastics, acrylics, . . . etc.), and respectively mounted in the box frame 1. Each lamp tube holder 4 holds a lamp tube 41. The lamp tubes 41 are respectively connected to respective fluorescent ballasts 51 and starters 52 in the electric box 5 by respective electric wires. When the side board 3 is pulled out of the longitudinal sliding track 21, the lamp tubes 41 can be conveniently removed from the respective lamp tube holders 4 for a replacement. The electric box 5 has a barrel 54 at one end namely the fixed end, and a hook 53 at an opposite end namely the free end. The barrel 54 is pivoted to the bottom side of the box frame 1 by a pivot 55. When the electric box 5 is turned upwards and closely attached to the bottom side of the box frame 1, the hook 53 is hooked on a part of the box frame 1 to secure the electric box 5 in the closed position. When the hook 53 is disengaged from the box frame 1, the electric box 5 is turned outwards and opened for a repair work.

Figure 3:
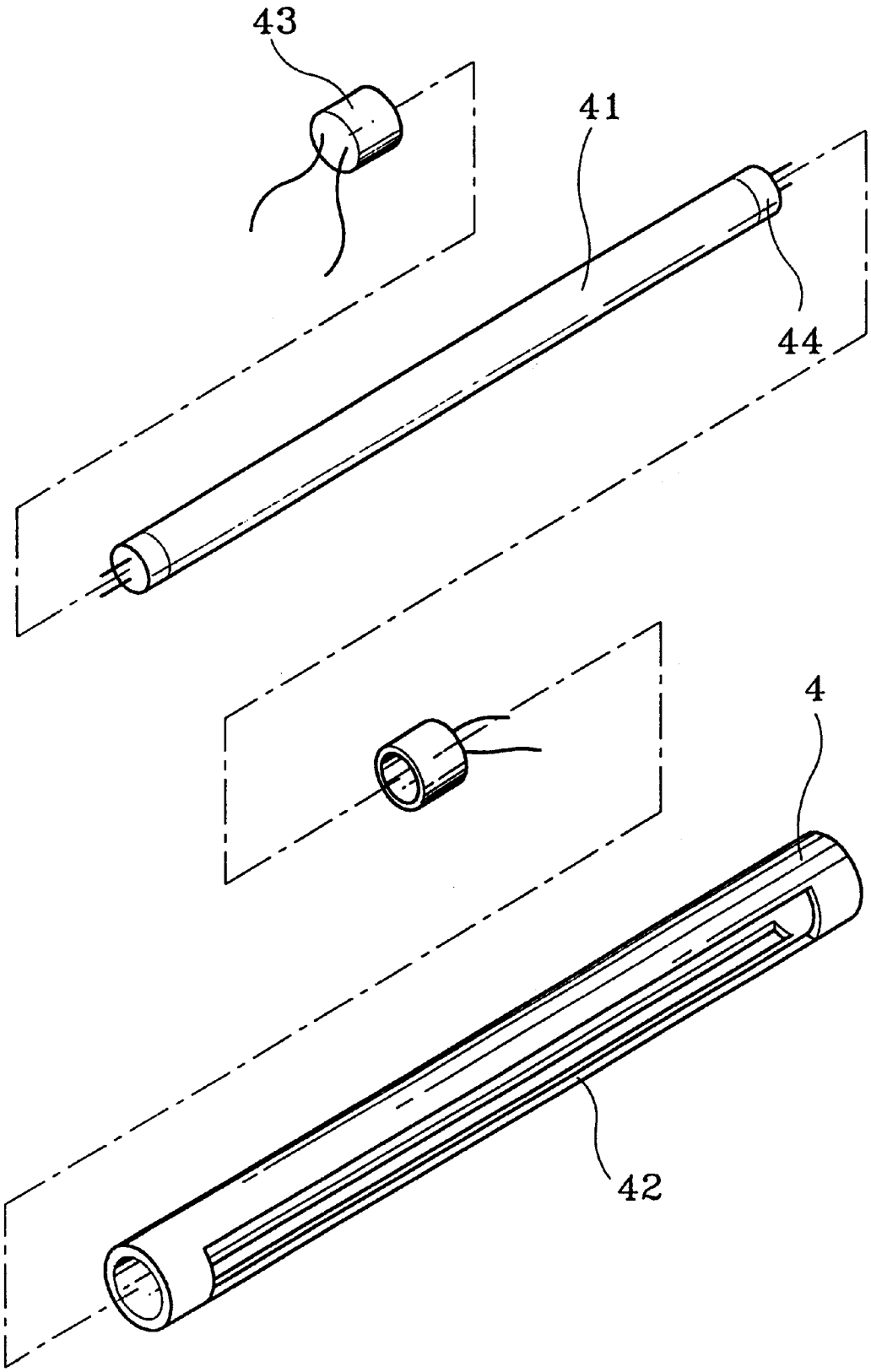
FIG. 3 is an exploded view of a lamp tube holder, a lamp tube, and two sealing caps according to the present invention.

Referring to FIG. 3, the lamp tube holder 4 comprises a plurality of longitudinal ribs 42 defining a plurality of open spaces. Through the open spaces, heat can be quickly dissipated from the lamp tube 41 into the air outside the sign box. The base 44 at each end of the lamp tube 41 is covered with a respective sealing cap 43, which seals out rain water.

Figure 4:
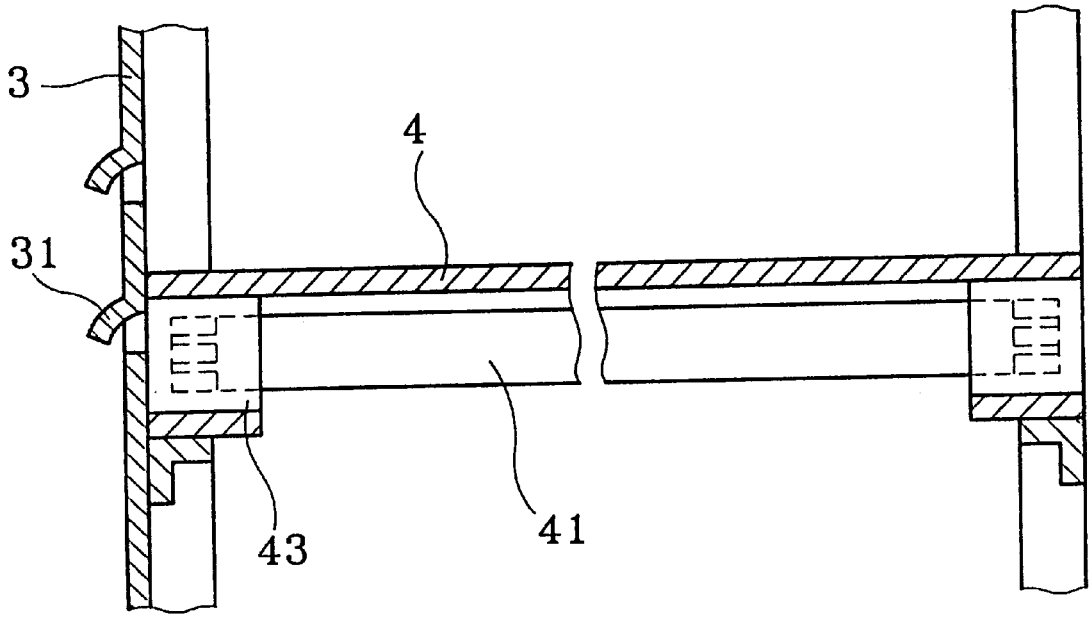
FIG. 4 is a sectional view in an enlarged scale of a part of the sign box shown in FIG. 1.

Referring to FIG. 4, the lamp tube 41 is mounted in the lamp tube holder 4, and the side board 3 is stopped at one end of the lamp tube holder 4. When the side board 3 is taken way, the lamp tube 41 is pulled out of the lamp tube holder 4, then the sealing cap 43 at the outer end of the lamp tube 41 is removed from the lamp tube 41, then the lamp tube 41 is taken out of the lamp tube holder 4, and then the sealing cap 43 at the inner end of the lamp tube 41 is removed from the lamp tube 41, and a new lamp tube can then be installed.

Figure 5:
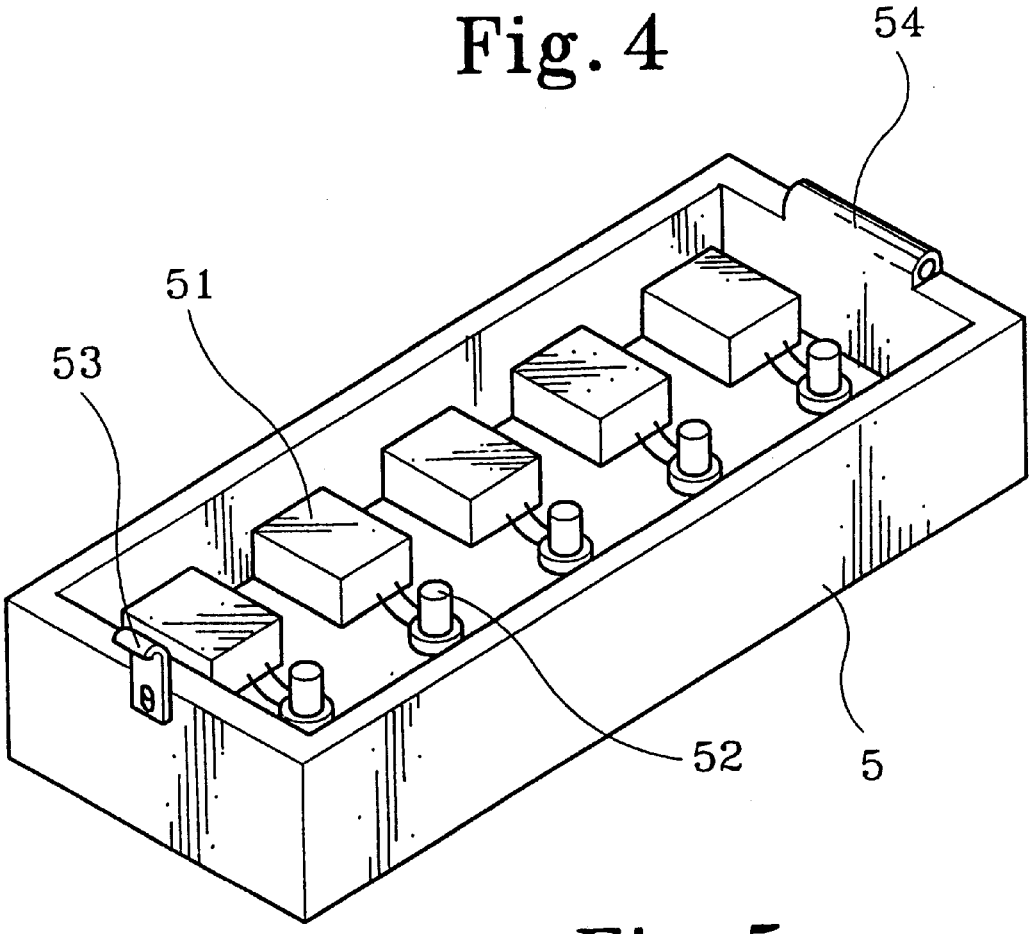
FIG. 5 is a perspective view in an enlarged scale of the electric box shown in FIG. 2.

Referring to FIG. 5 and FIGS. 1 and 2 again, because the fluorescent ballasts 51 and the starters 52 are respectively mounted in the electric box 5, the maintenance engineer can conveniently inspect the fluorescent ballasts 51 and the starters 52 at first before checking the lamp tubes 41. When the hook 53 is disengaged from the box frame 1, the electric box 5 is opened, for enabling the maintenance engineer to inspect the fluorescent ballasts 51 and the starters 52 conveniently.

Figure 6A:
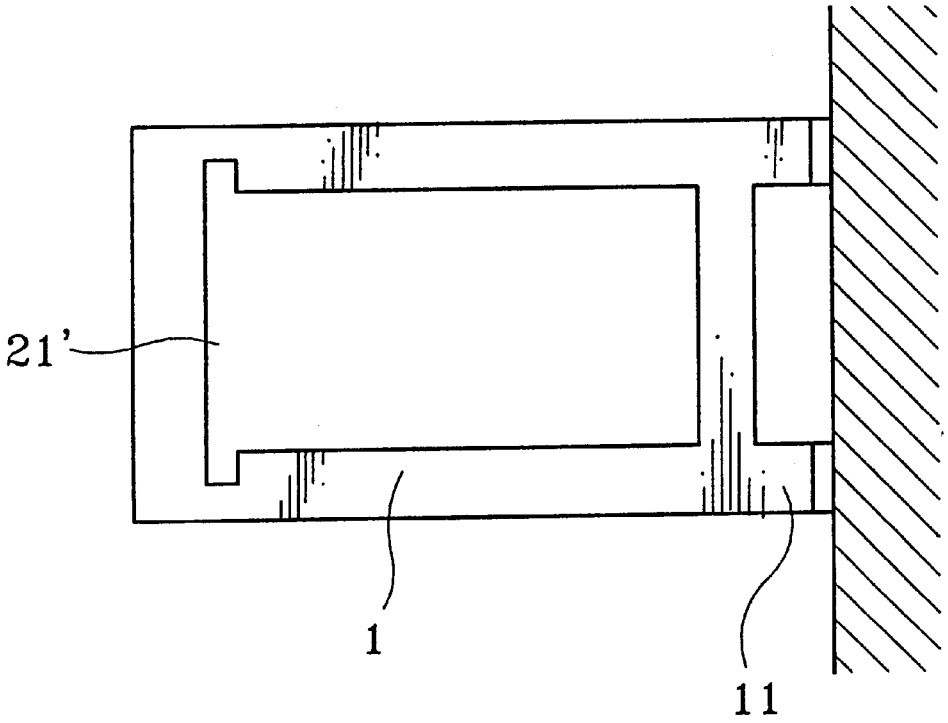
FIG. 6A is a cross sectional view of an alternate form of the box frame according to the present invention.
Figure 6B:
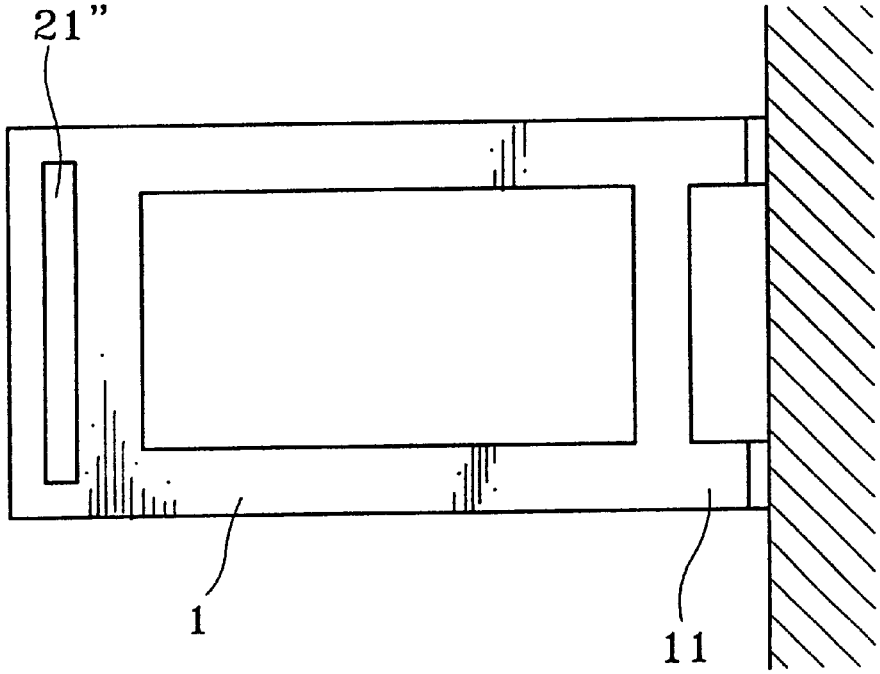
FIG. 6B is a cross sectional view of another alternate form of the box frame according to the present invention.

Referring to FIGS. 6A and 6B, the longitudinal sliding track 21 or 21" can be made inside the box frame 1. When the side board is inserted into the longitudinal sliding track 21 or 21', the outer side of the box frame 1 is closed. When the side board is removed from the longitudinal sliding track 21 or 21', a maintenance work can easily be performed.

Figure 7A:
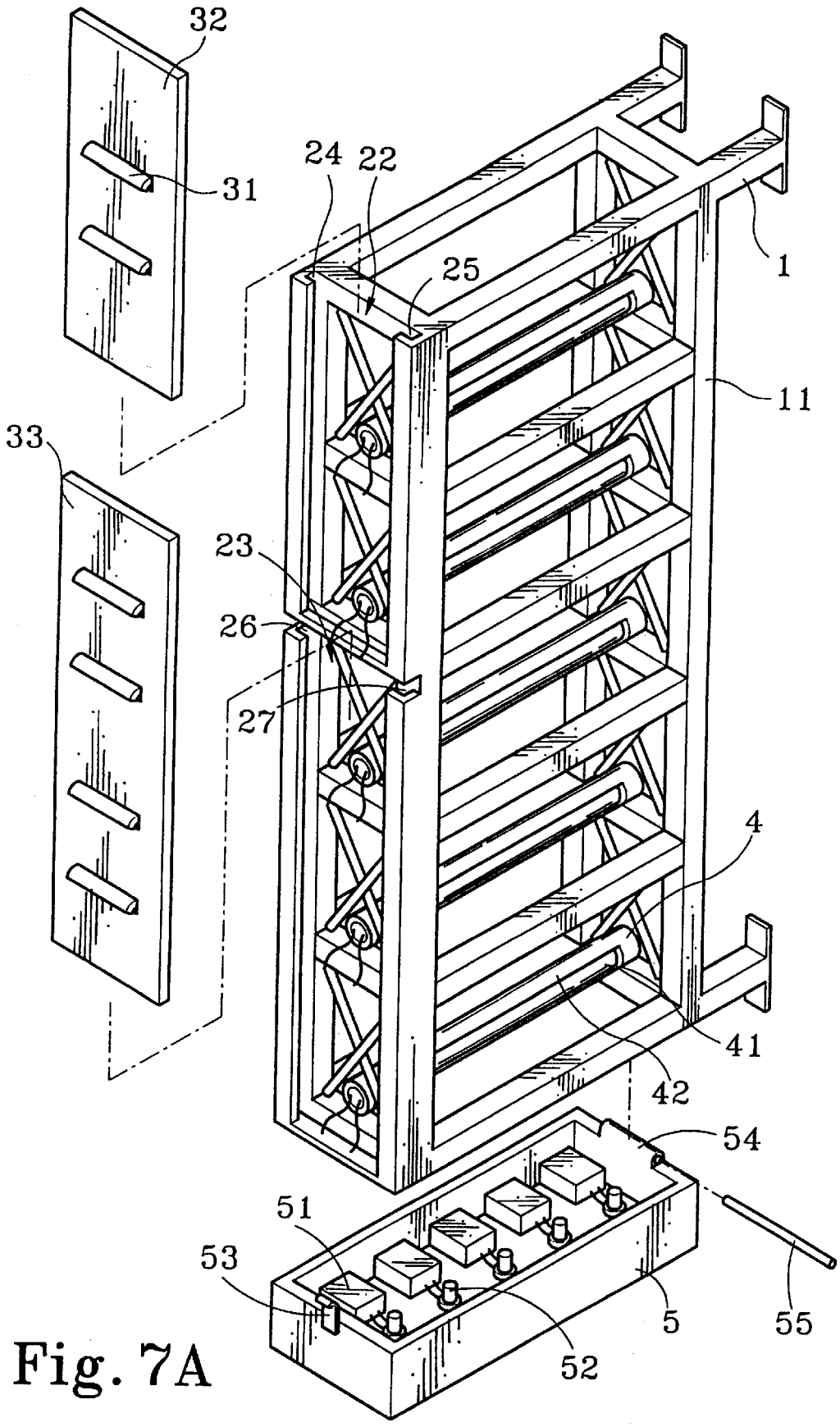
FIG. 7A is an exploded view of an alternate form of the sign box according to the present invention.

Referring to FIG. 7A, the box frame 1 is made having vertically aligned pairs of parallel rails 24 and 25; 26 and 27, each pair of parallel rails 24 and 25; 26 and 27 defining a respective longitudinal sliding track 22 or 23. Side boards 32 and 33 are respectively inserted into the longitudinal sliding tracks 22 and 23. Because a number of side boards are used to close the outer side of the box frame instead of a single side board, the individual side boards can easily removed from the box frame with less effort.

Figure 7B:
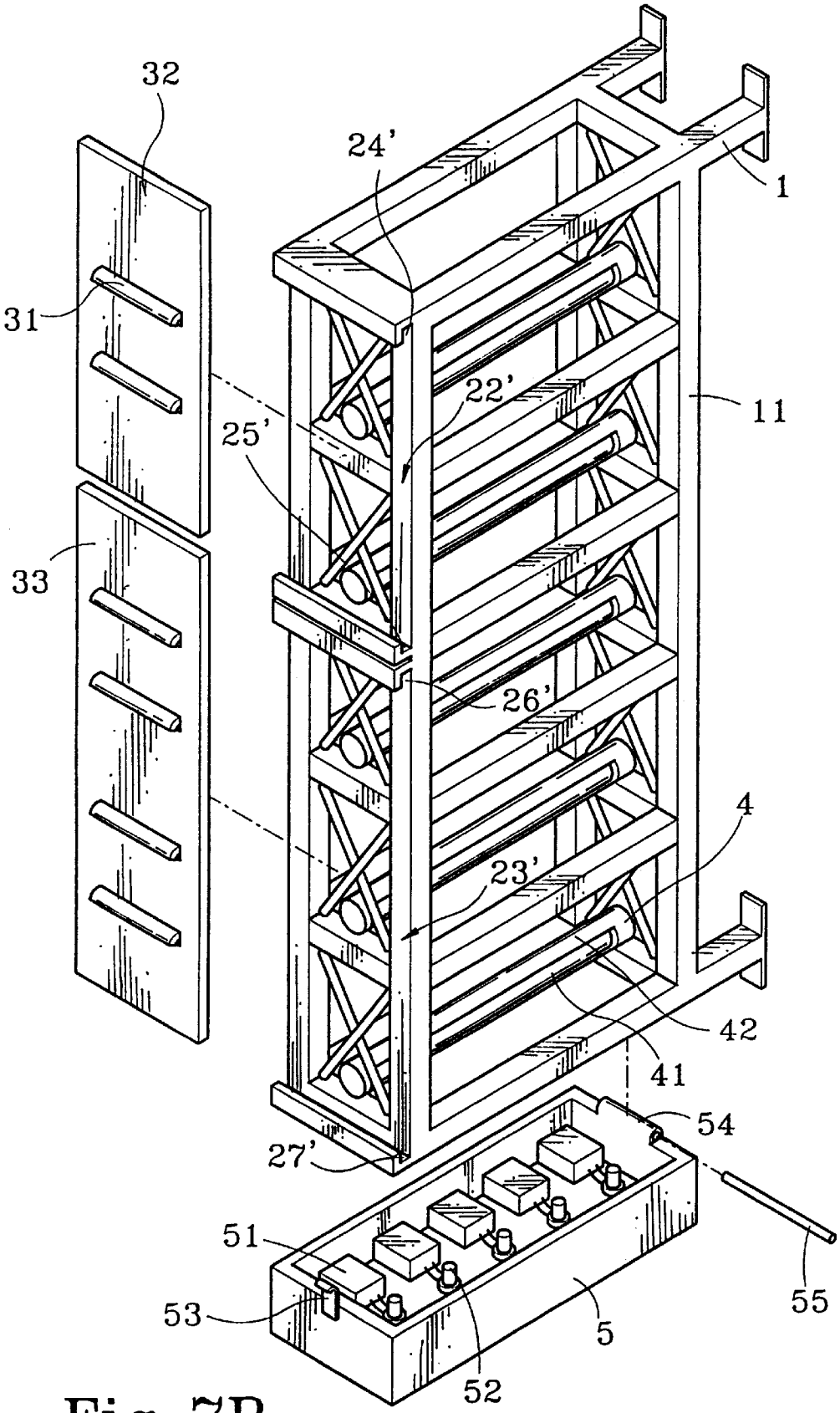
FIG. 7B is an exploded view of another alternate form of the sign box according to the present invention.

Referring to FIG. 7B, the box frame 1 is made having pairs of parallel rails 24' and 25'; 26' and 27' arranged at an outer side at different elevations, each pair of parallel rails 24' and 25'; 26' and 27' defining a respective transverse sliding track 22' or 23'. The side boards 32 and 33 are respectively inserted into the transverse sliding tracks 22' and 23'.

As indicated above, lamp tube holders 4 are used and installed in the box frame 1 to hold the respective lamp tubes 41, enabling the lamp tubes 41 to be conveniently removed from the box frame 1 for a replacement; an electric box 5 is hinged to the box frame 1 to hold the respective fluorescent ballasts 51 and starters 52 of the lamp tubes 41, enabling the maintenance engineer to inspect the fluorescent ballasts 51 and starters 52 of the lamp tubes 41 conveniently.

What is claimed is:

1. A sign box comprising:

a box frame fixedly mounted on an outside wall of a building;

a plurality of transparent lamp tube holders respectively mounted in said box frame and holding a respective lamp tube;

at least one pair of parallel rails provided at one side of said box frame, said at least one pair of parallel rails each defining a sliding track; and at least one cover board respectively inserted into the sliding track of said at least one pair of parallel rails.

2. The sign box of claim 1 further comprising an electric box hinged to said box frame at a bottom side for controlling the operation of the lamp tubes in said lamp tube holders.

3. The sign box of claim 2 wherein said electric box has one end hinged to said box frame.

4. The sign box of claim 3 wherein said electric box has an opposite end releasably secured to said box frame by hook means thereof.

5. The sign box of claim 1 wherein said lamp tube holders each comprise a plurality of longitudinal ribs defining a plurality of open spaces.

6. The sign box of claim 1 wherein the lamp tubes in said lamp tube holders each have two opposite ends respectively covered with a respective sealing cap.

7. The sign box of claim 1 wherein said at least one pair of parallel rails are integral with said box frame at one side.

8. The sign box of claim 1 wherein said at least one pair of parallel rails are integral with said box frame on the inside.

9. The sign box of claim 1 wherein said at least one pair of parallel rails are arranged at said box frame in longitudinal direction for allowing said at least one cover board to be respectively longitudinally loaded in the sliding track in said at least one pair of parallel rails.

10. The sign box of claim 1 wherein said at least one pair of parallel rails are arranged at said box frame in transverse direction for allowing said at least one cover board to be respectively transversely loaded in the sliding track in said at least one pair of parallel rails.

11. The sign box of claim 1 wherein said at least one cover board each have a plurality of air vents.

* * * * *